US012331667B2

(12) United States Patent
Harral et al.

(10) Patent No.: US 12,331,667 B2
(45) Date of Patent: Jun. 17, 2025

(54) FLOW DRAINING ENHANCEMENT SYSTEM FOR ENGINE SUMP CAVITIES

(71) Applicant: Rolls-Royce North American Technologies Inc., Indianapolis, IN (US)

(72) Inventors: Jacob Harral, Indianapolis, IN (US); Michael Kabbes, Indianapolis, IN (US); Michael Dornfeld, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 0 days.

(21) Appl. No.: 18/314,900

(22) Filed: May 10, 2023

(65) Prior Publication Data

US 2024/0376836 A1 Nov. 14, 2024

(51) Int. Cl.

| | |
|---|---|
| ***F01M 11/04*** | (2006.01) |
| ***F01M 11/00*** | (2006.01) |
| ***F01M 11/06*** | (2006.01) |
| ***F01M 11/12*** | (2006.01) |

(52) U.S. Cl.

CPC ..... *F01M 11/0408* (2013.01); *F01M 11/0004* (2013.01); *F01M 11/062* (2013.01); *F01M 11/12* (2013.01)

(58) Field of Classification Search

CPC .. F01M 1/12; F01M 11/0004; F01M 11/0408; F01M 11/062; F01M 11/064; F01M 11/065; F01M 11/12; F01M 2011/0041; F16K 31/18; F16K 31/20; F16K 31/28; F16K 31/22; F16H 57/0408; F16H 57/0443

See application file for complete search history.

(56) References Cited

U.S. PATENT DOCUMENTS

| | | | | | |
|---|---|---|---|---|---|
| 885,056 | A * | 4/1908 | Kieser | F01M 11/0004 | 184/106 |
| 1,132,833 | A * | 3/1915 | Coseo | F16K 31/22 | 137/434 |
| 1,989,816 | A * | 2/1935 | Meyer | F01M 11/065 | 184/6.2 |
| 2,446,384 | A * | 8/1948 | Murdock | F16K 31/22 | 210/123 |
| 4,762,201 | A * | 8/1988 | Malik | F16N 19/003 | 184/6.13 |
| 2007/0017559 | A1* | 1/2007 | Yamaguchi | B60S 1/481 | 134/123 |
| 2009/0218169 | A1* | 9/2009 | Kawamura | F01M 13/00 | 184/6.5 |
| 2011/0056452 | A1* | 3/2011 | Horner | F01M 11/064 | 222/3 |
| 2013/0087220 | A1* | 4/2013 | Schlekewy | F16K 31/20 | 137/409 |
| 2014/0331639 | A1* | 11/2014 | Raimarckers | F01D 25/20 | 184/26 |

* cited by examiner

*Primary Examiner* — Minh Truong

(74) *Attorney, Agent, or Firm* — Barnes & Thornburg LLP

(57) ABSTRACT

Scavenge systems for a gas turbine engine including a valve positioned at a first drainage outlet of an enclosure to selectively open and evacuate liquid from the cavity through the first drainage outlet in response to the valve being submerged in liquid are provided. Methods of reducing suction of air from an enclosure of a cavity of a gas turbine engine are further provided.

20 Claims, 5 Drawing Sheets

FLOW DRAINING ENHANCEMENT SYSTEM FOR ENGINE SUMP CAVITIES

TECHNICAL FIELD

The present disclosure relates generally to machine components requiring removal of lubricant, and more specifically to systems and methods of removing lubricant from the machine components during operating conditions.

BACKGROUND

Turbine engines are used in a wide variety of power and propulsion applications. An oil sump is an enclosed cavity in a turbine engine where lubricant-wetted components will reside to receive the requisite cooling and lubrication. The oil sump scavenges lubricant via gravity or through a suction pump ("scavenge pump"), or through a combination of gravity and a suction pump. Suction pumps pull an air/oil mix from an oil sump to deliver the return oil for filtering, cooling, and re-use of the oil. When suction pumps are exposed to open air in an oil sump, the pump sucks air and does not pull any meaningful amount of lubricant through the pump.

On some applications of gas turbine engines, there may be severe attitude requirements that the engine must operate such that the gas turbine engine is not level or horizontal with the earth's surface. Such attitude requirements may be pitch and roll requirements, and may increase the difficulty of scavenging lubricant in an oil sump. When a gas turbine engine is not level, lubricant may pool away from a drainage outlet connected to a suction pump or submerge only one drainage outlet while another drainage outlet is open to air in the oil sump.

Conventionally, each drainage outlet has been accompanied by a dedicated suction pump element. The numerous suction pump elements add weight to gas turbine engines and scavenge pumps and increase costs associated with the additional parts, materials, cast housings, and external tubes required for gas turbine engines. Accordingly, there remains a need for further contributions in this area of technology.

BRIEF DESCRIPTION OF THE DRAWINGS

The present disclosure may be better understood with reference to the following drawings and description. The components in the figures are not necessarily to scale. Moreover, in the figures, like-referenced numerals designate corresponding parts throughout the different views.

Figure 1:
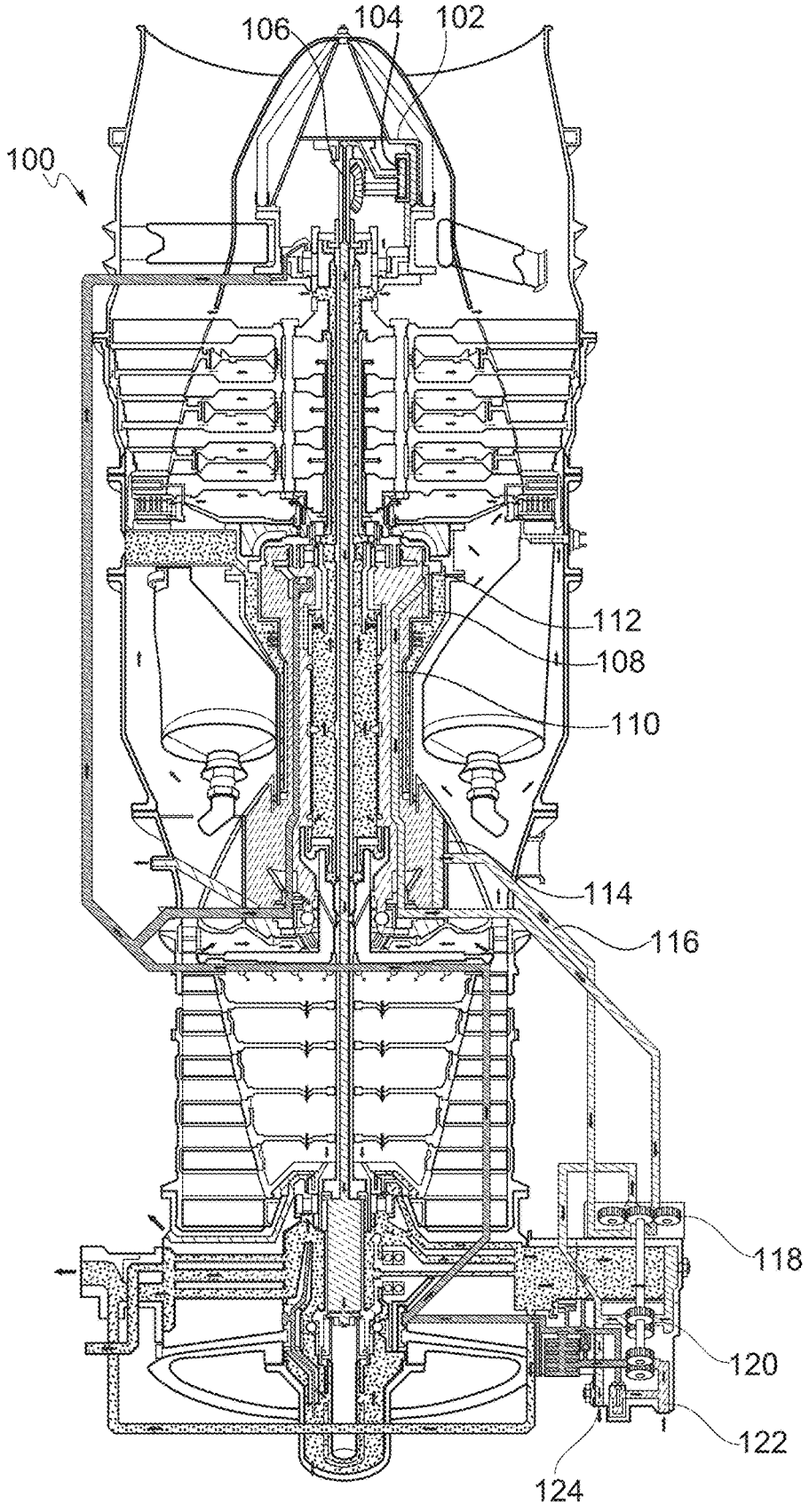
FIG. 1 illustrates a longitudinal forward-aft cross-sectional view of an example of a gas turbine engine.

The drawings described herein are for illustration purposes only and are not intended to limit the scope of the present disclosure in any way.

DETAILED DESCRIPTION

According to an example, the present disclosure provides an oil sump system for a gas turbine engine. The oil sump system includes a first oil drainage outlet in a surface of the oil sump. The oil sump system further includes a second oil drainage outlet in the surface, the second oil drainage outlet in liquid communication with the first oil drainage outlet. The oil sump system further includes a suction pump in liquid communication with the first oil drainage outlet and the second oil drainage outlet. The oil sump system further includes a valve positioned at the first oil drainage outlet to selectively open and evacuate liquid from the oil sump through the first oil drainage outlet in response to the valve being submerged in liquid, the liquid accumulating on the surface when the gas turbine engine is at level flight.

An interesting feature of the systems and methods described below may be to remove a need for an equal number of drainage outlets and suction pumps, and the reduced number of suction pumps may reduce the weight of a scavenge system significantly, for example by 25% to 35%. Alternatively, or in addition, an interesting feature of the apparatuses and methods described below may be that the cost of a scavenge system is reduced by a reduction in the number of required parts and/or a reduction in materials. Alternatively, or in addition, an interesting feature of the apparatuses and methods described below may be that the cost and weight of the scavenge system is reduced by a reduction in the cost and weight of required cast housings and external tubes.

For purposes of promoting an understanding of the principles of the disclosure, reference will now be made to the examples illustrated in the drawings, and specific language may be used to describe the same. It will nonetheless be understood that no limitation of the scope of the disclosure is intended by the illustration and description of certain examples of the disclosure. In addition, any alternations and/or modifications of the illustrated and/or described example(s) are contemplated as being within the scope of the present disclosure. Further, any other applications of the principles of the disclosure, as illustrated and/or described herein, as would normally occur to one skilled in the art to which the disclosure pertains, are contemplated as being within the scope of the present disclosure.

Referring to FIG. 1, a longitudinal forward-aft cross-sectional view of an example of a gas turbine engine 100 is illustrated. Gas turbine engine 100 includes rear turbine sump 102, which is an example of an enclosure of a cavity of gas turbine engine 100 in which a liquid 112 may collect. Examples of liquid 112 may include lubricants and oils. Rear turbine scavenge pump 104 may remove liquid 112 from rear turbine sump 102, and the liquid may flow through scavenge conduit 106. Gas turbine engine 100 includes front turbine sump 108 and rear compressor sump 114. Front turbine conduit 110 may remove liquid 112 from front turbine sump 108 and rear compressor conduit 116 may remove liquid 112 from rear compressor sump 114. Front turbine conduit 110 and rear compressor conduit 116 are both connected to external scavenge pump 118, which pulls liquid 112 from rear compressor sump 114 and front turbine sump 108. Main scavenge pump 120 also operates to pull liquid 112 from rear compressor sump 114 and front turbine sump 108. After liquid 112 is pulled through external scavenge pump 118 and main scavenge pump 120, liquid 112 is removed from gas turbine engine 100 through scavenge outlet 124. Liquid 112 enters gas turbine engine 100 through inlet 122.

Figure 2:
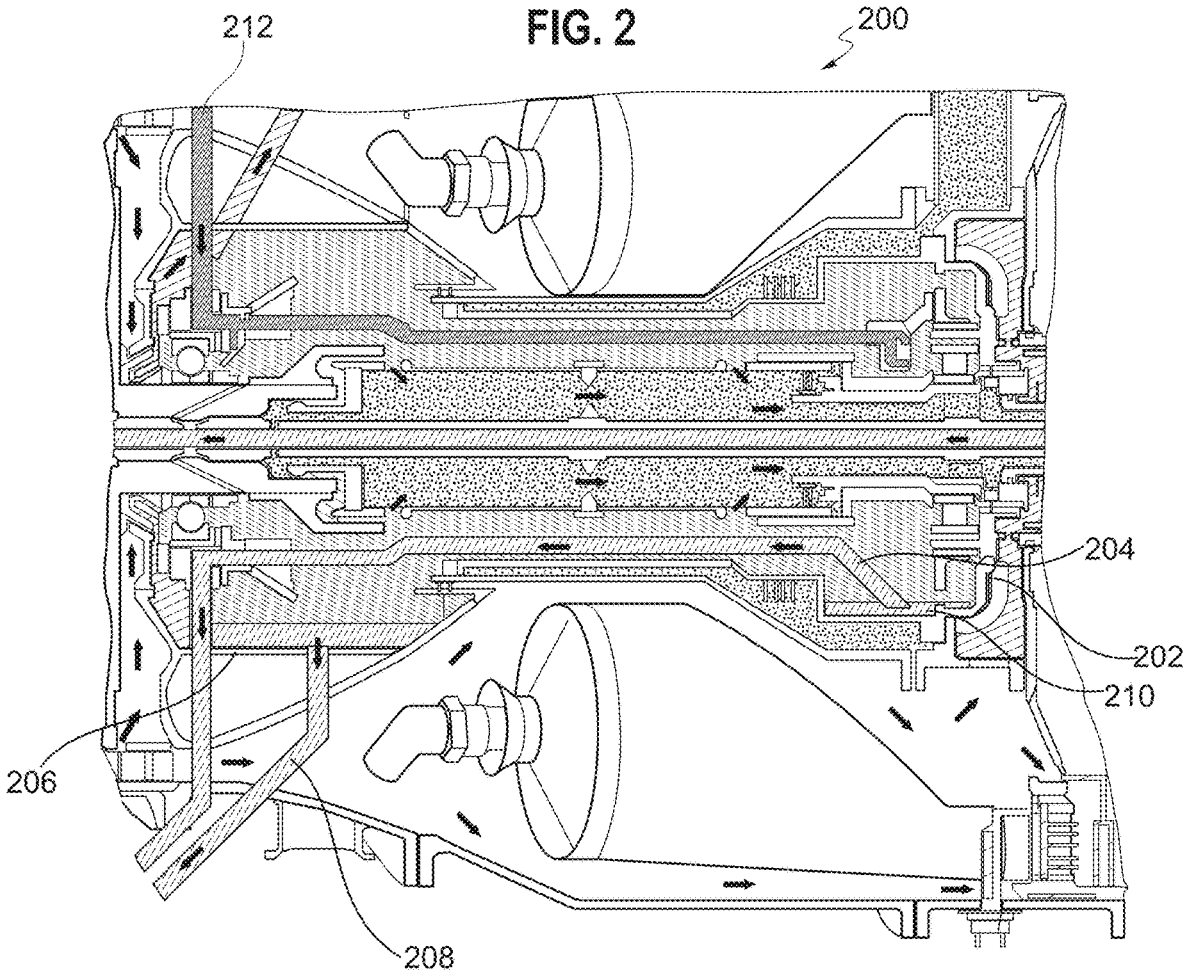
FIG. 2 illustrates a partial exploded longitudinal forward-aft cross-sectional view of another example of a gas turbine engine.

Referring to FIG. 2, a partial exploded longitudinal forward-aft cross-sectional view of another example of a gas turbine engine 200 is illustrated. Gas turbine engine 200 includes aft enclosure 202 of a cavity in which liquid 210 may accumulate. Gas turbine engine 200 also includes forward enclosure 206 of a cavity in which liquid 210 may accumulate. Liquid 210 may be removed from aft enclosure 202 through aft drainage outlet 204 and from forward enclosure 206 through forward drainage outlet 208. Examples of forward enclosure 206 and aft enclosure 202 may include sumps or oil sumps. Supply line 212 provides liquid, such as oil, to gas turbine engine 200.

Figure 3:
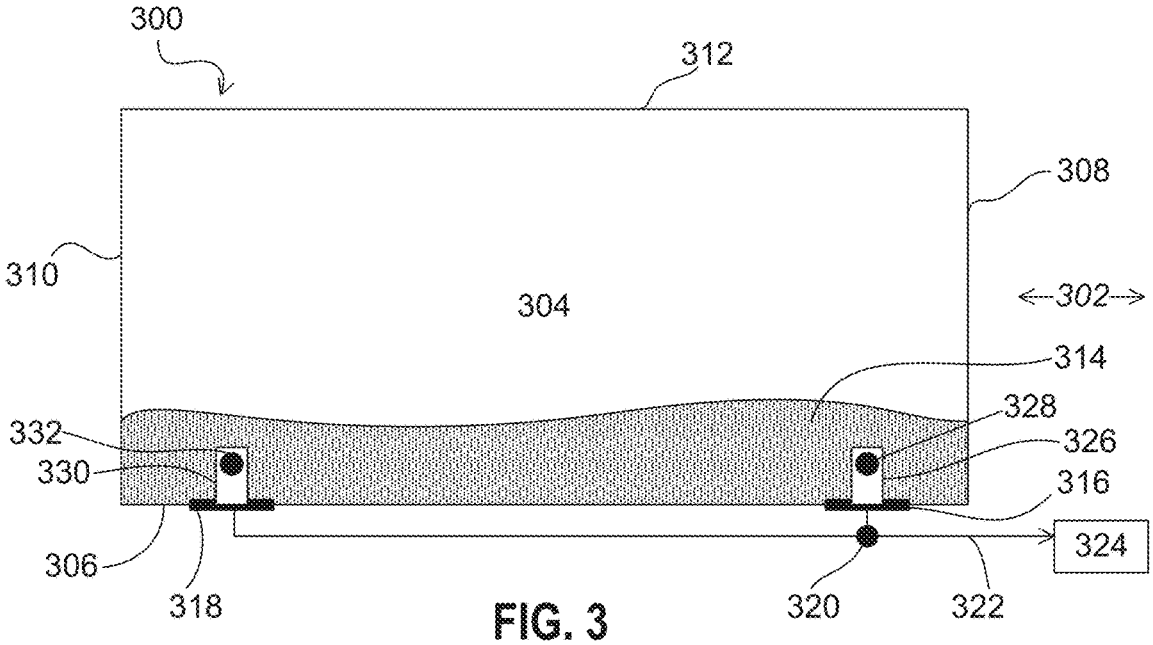
FIG. 3 illustrates a schematic of an example of a scavenge system of a gas turbine engine at level flight, in accordance with the principles of the present disclosure.

Referring to FIG. 3, a schematic of an example of a scavenge system 300 of a gas turbine engine at level flight is illustrated. "Level flight" refers to aerial operation of the gas turbine engine at an orientation 302 that is substantially horizontal and that is also substantially parallel to the surface of the earth. Scavenge system 300 includes enclosure 312 defining cavity 304. Enclosure 312 includes side walls including aft side wall 310 and forward side wall 308, and bottom 306 and a top that connect the side walls, such as to form enclosure 312. At level flight, bottom 306 is closest to a surface of the earth. At level flight, liquid 314 in cavity 304 collects on bottom 306 as a result of positive gravitational force. Bottom 306 includes first drainage outlet 316 and second drainage outlet 318. Liquid 314 will create a seal at first drainage outlet 316 and second drainage outlet 318.

Valves are located at first drainage outlet 316 and second drainage outlet 318, and may include valves 326, 330 respectively. First drainage outlet 316 is forward of second drainage outlet 318. Examples of valves 326, 330 may include float valves. In other examples, the valves may be ball float valves, gate valves, or valves including actuated control flow, such as electrically or pneumatically by a controller, to move between an open position that allows the flow of liquid 314 and a closed position that does not allow the flow of liquid 314. In the example illustrated in FIG. 3, valves 326, 330 include spherical elements 328, 332, respectively. Spherical elements 328, 332 are fabricated from material such that spherical elements 328, 332 are advantageously buoyant in liquid 314. Valves 326, 330 selectively and independently open and evacuate liquid from cavity 304 in response to valves 326, 330 being independently submerged in liquid.

First drainage outlet 316 is in liquid communication with second drainage outlet 318 at junction point 320. Junction point 320 is in liquid communication with suction pump 324 by scavenge conduit 322. By connecting first drainage outlet 316 and second drainage outlet 318 to suction pump 324, only the single suction pump 324 is required to remove oil through both, or either, first drainage outlet 316 and second drainage outlet 318. In other examples, any number of drainage outlets greater than two are possible.

Liquid 314 submerges both first drainage outlet 316 and second drainage outlet 318 when the gas turbine engine is operating at level flight, as illustrated in FIG. 3. Spherical elements 328, 332, which are advantageously fabricated from material that is buoyant in liquid 314, rise to the top of the housing of valves 326, 330, respectively, thereby opening valves 326, 330 for evacuation of liquid from cavity 304 through first drainage outlet 316 and second drainage outlet 318.

Figure 4:
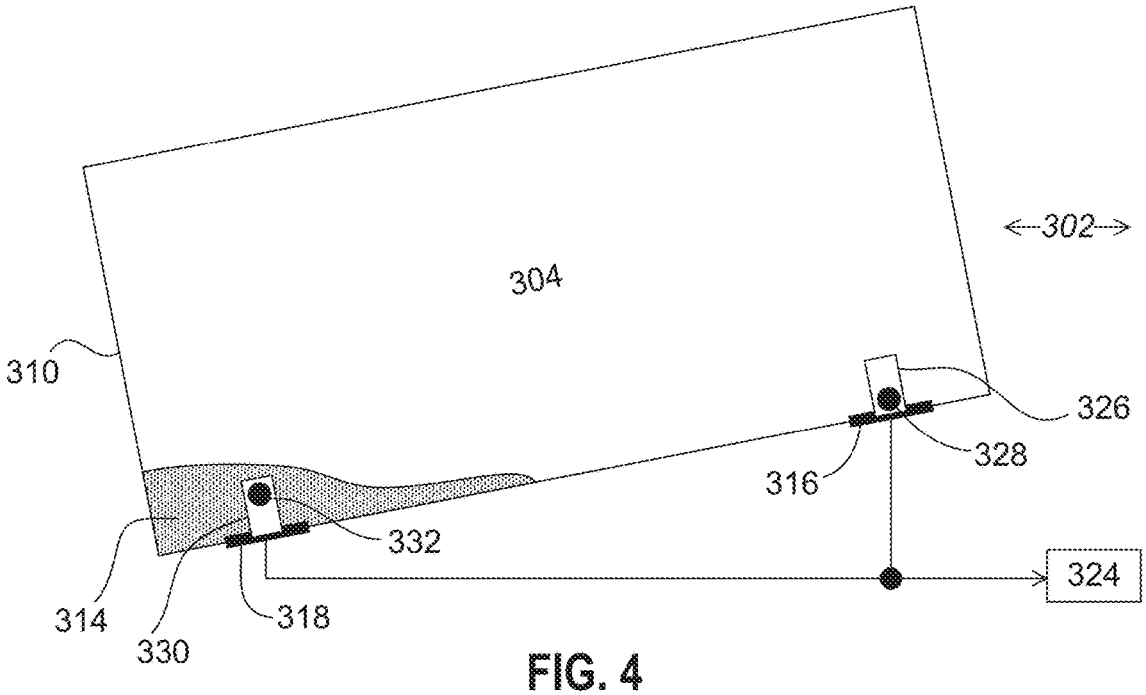
FIG. 4 illustrates a schematic of the example of FIG. 3 at un-level flight, in accordance with the principles of the present disclosure.

Referring to FIG. 4, a schematic of scavenge system 300 at un-level flight is illustrated. "Un-level flight" refers to aerial operation of the gas turbine engine at an orientation that is not horizontal and that is also not parallel to the surface of the earth. As illustrated in FIG. 4, liquid 314 accumulates unevenly on bottom 306, in a corner where bottom 306 and aft side wall 310 meet, due to the un-level flight orientation. Second drainage outlet 318 is submerged in liquid 314 at the un-level flight orientation illustrated in FIG. 4. Therefore, only spherical element 332 of valve 330 at second drainage outlet 318 will float in liquid 314, thereby opening valve 330 to the evacuation of liquid 314. By contrast, first drainage outlet 316 is not submerged in liquid 314 at the un-level flight orientation illustrated in FIG. 4. Spherical element 328 of valve 326 at first drainage outlet 316 has no liquid 314 in which to float, and seals valve 326 by resting in the housing at the bottom of valve 326 due to positive gravitational force and/or pressure from suction pump 324.

Figure 5:
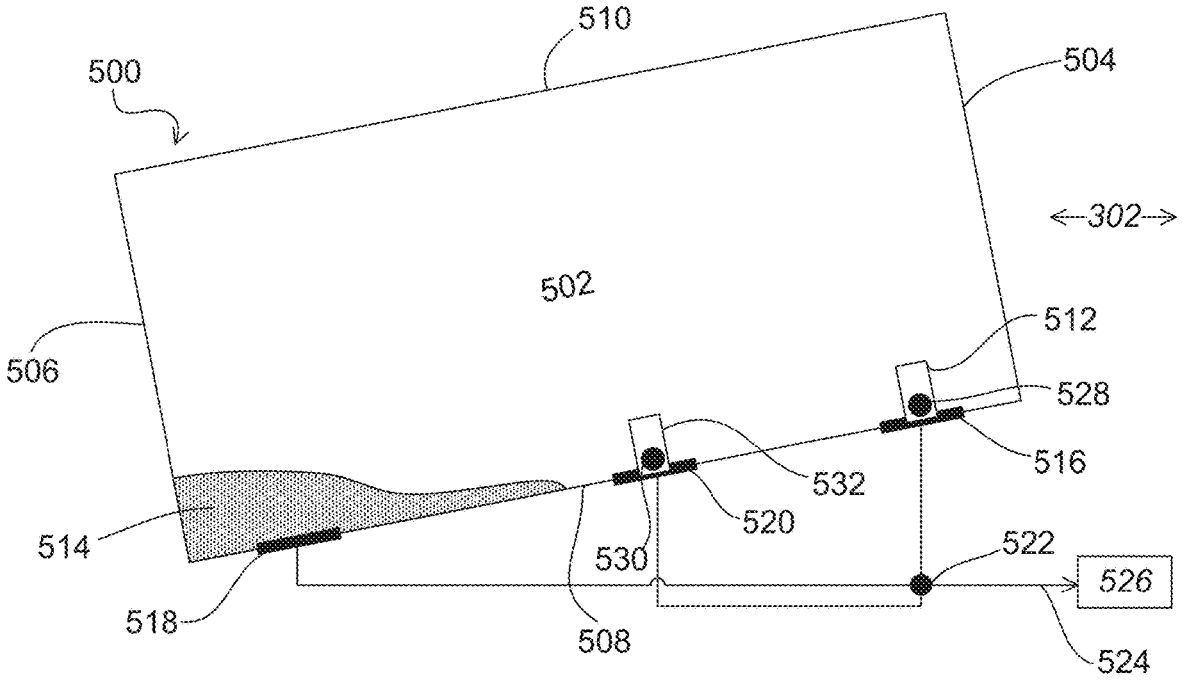
FIG. 5 illustrates a schematic of another example of a scavenge system of a gas turbine engine at un-level flight, the scavenge system including a third drainage outlet, in accordance with the principles of the present disclosure.

Referring to FIG. 5, a schematic of another example of a scavenge system 500 of a gas turbine engine at un-level flight is illustrated. Scavenge system 500 includes enclosure 510 defining cavity 502. Enclosure 510 includes side walls including aft side wall 506 and forward side wall 504, and bottom 508 and a top that connect the side walls, such as to form enclosure 510. At un-level flight as illustrated in FIG. 5, liquid 514 accumulates unevenly on bottom 508, in a corner where bottom 508 and aft side wall 506 meet. Bottom 508 includes first drainage outlet 516, second drainage outlet 520, and third drainage outlet 518. Third drainage outlet 518 is aft relative to first drainage outlet 516 and second drainage outlet 520, and at the un-level flight illustrated in FIG. 5, third drainage outlet is submerged in liquid 514.

First drainage outlet 516 and second drainage outlet 520 include valves 512 and 532, respectively, but third drainage outlet 518 does not include a valve. Valves 512, 532 include spherical elements 528, 530, respectively. First drainage outlet 516 and second drainage outlet 520 are not submerged in liquid 514 at the un-level flight orientation illustrated in FIG. 5, and therefore spherical elements 528, 530 seal valves 512, 532, respectively, by resting in the respective housings at the bottom of valves 512, 532 due to positive gravitational force.

First drainage outlet 516, second drainage outlet 520, and third drainage outlet 518 are each in liquid communication with scavenge conduit 524. In the example illustrated in FIG. 5, first drainage outlet 516, second drainage outlet 520, and third drainage outlet 518 are each in liquid communication with junction point 522, and consequently, first drainage outlet 516 is in liquid communication with second drainage outlet 520 and with third drainage outlet 518 at junction point 522. Further, second drainage outlet 520 is in liquid communication with third drainage outlet 518 at junction point 522. Junction point 522 is in liquid communication with suction pump 526 by scavenge conduit 524. In other examples, second drainage outlet 520 and third drainage outlet 518 may be in liquid communication with a second junction point that is in liquid communication with junction point 522. scavenge conduit 524 may be a common header with which each of first drainage outlet 516, second drainage outlet 520, and third drainage outlet 518 are in liquid communication independently, or in combination.

In a condition in which cavity 502 includes no liquid, such as at startup of the gas turbine engine, suction pump 526 would pull a vacuum such that significant upward pressure may be required on spherical elements 528, 530 for liquid to flow through first drainage outlet 516 or second drainage outlet 520. At least to avoid such a startup vacuum scenario, a valve is not included in at least third drainage outlet 518.

Figure 6:
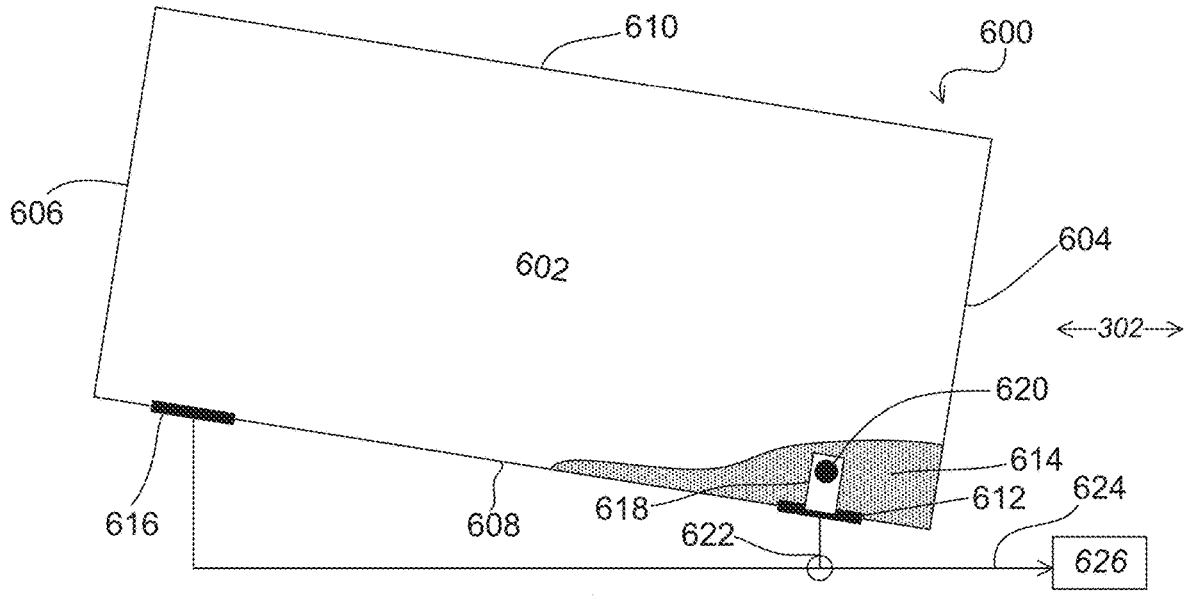
FIG. 6 illustrates a schematic of yet another example of a scavenge system of a gas turbine engine at un-level flight, in accordance with the principles of the present disclosure.

Referring to FIG. 6, a schematic of yet another example of a scavenge system 600 of a gas turbine engine at un-level flight is illustrated. Scavenge system 600 includes enclosure 610 defining cavity 602. Enclosure 610 includes side walls including aft side wall 606 and forward side 604, and bottom 608 and a top that connect the side walls, such as to form enclosure 610. At un-level flight as illustrated in FIG. 6, liquid 614 accumulates unevenly on bottom 608, in a corner where bottom 608 and forward side wall 604 meet. Bottom 608 includes first drainage outlet 612 and second drainage outlet 616. At the un-level flight illustrated in FIG. 6, first drainage outlet 612 is submerged in liquid 614.

Valve 618 is located at first drainage outlet 612. Valve 618 includes spherical element 620. Spherical element 620, which is advantageously fabricated from material that is buoyant in liquid 614, rises to the top of the housing of valve 618, thereby opening valve 618 for evacuation of liquid from cavity 602 through first drainage outlet 612.

First drainage outlet 612 is in fluid communication with second drainage outlet 616 at junction point 622. Junction point 622 is in fluid communication with suction pump 626 by scavenge conduit 624. When first drainage outlet 612 is submerged in liquid 614 at the un-level flight orientation illustrated in FIG. 6, first drainage outlet 612 will transition to a gravity drain until junction point 622. At junction point 622 and along scavenge conduit 624, suction pump 626 will pull liquid 614 out of scavenge system 600.

Figure 7:
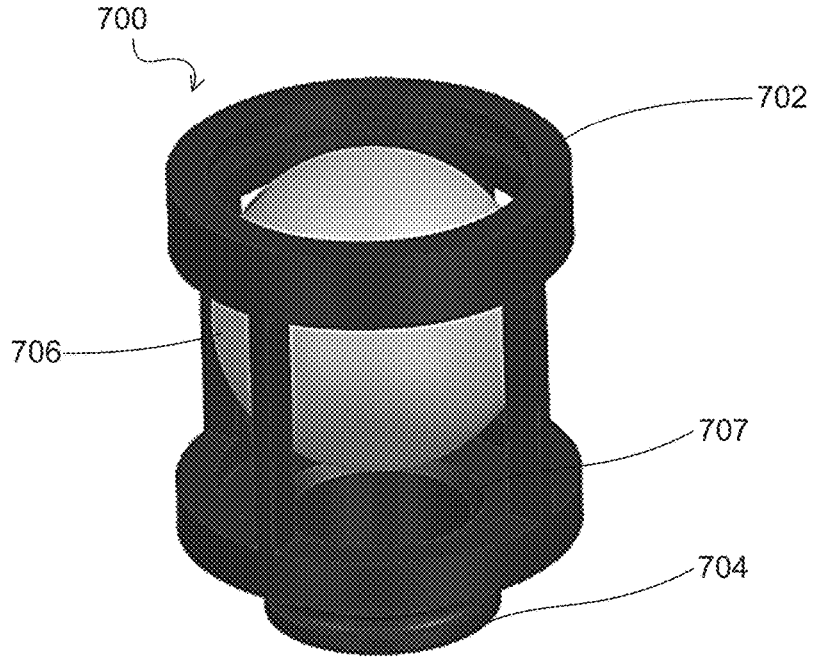
FIG. 7 illustrates a perspective view of an example of a valve at a drainage outlet of an enclosure of a cavity of a gas turbine engine, in accordance with the principles of the present disclosure.

Referring to FIG. 7, a perspective view of an example of valve 700 at a drainage outlet of a cavity of a gas turbine engine is illustrated. Valve 700 includes housing 702 and float 706. Float 706 may be advantageously fabricated from a material that is lighter than a liquid to be removed from the cavity, such that float 706 will be buoyant in the liquid when submerged in the liquid and will seal by gravity and/or pump pressure into seat 707 when not submerged in the liquid. As illustrated in FIG. 7, float 706 will float in housing 702 away from seat 707 when submerged in liquid (not shown) such that liquid may flow through bottom opening 704 of valve 700. As illustrated in FIG. 7, in an example, float 706 may have a spherical shape.

Figure 8A:
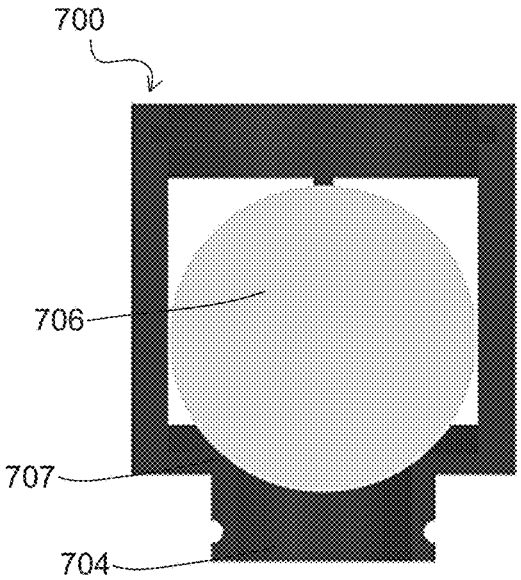
FIG. 8A illustrates a cross-sectional view of the example of a valve of FIG. 7 including a spherical element sealing shut the bottom opening of the valve, in accordance with the principles of the present disclosure.
Figure 8B:
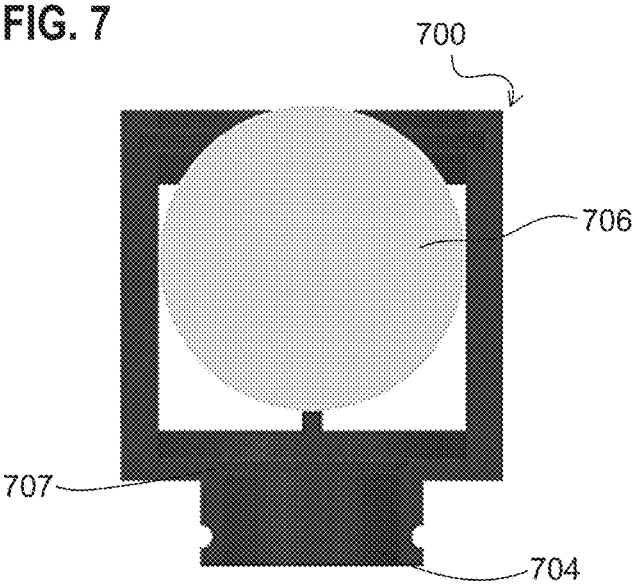
FIG. 8B illustrates a cross-sectional view of the example of a valve of FIG. 7 including a spherical element submerged in fluid such that the spherical element is buoyant in the fluid and the bottom opening of the valve is open to fluid flow, in accordance with the principles of the present disclosure.

Referring to FIG. 8A, a cross-sectional view of valve 700 is illustrated, in which float 706 is sealing bottom opening 704 by gravity and/or pump pressure into seat 707 because valve 700 is not submerged in liquid. Referring to FIG. 8B, float 706 is buoyant in the liquid (not shown) and rises away from seat 707 such that liquid may flow out of a cavity in the gas turbine engine through bottom opening 704.

By adding valves to at least some drainage outlets, the drainage outlets can be fluidically connected together and the drainage outlets can be fluidically connected to a single suction pump. Valves selectively and advantageously close unless submerged in fluid, and the single suction pump will not be able to pull air through a drainage outlet that is not submerged in fluid.

The present disclosure also provides methods for reducing suction of air from an enclosure of a cavity of a gas turbine engine. In an example, a method includes: blocking flow out of the enclosure through a first drainage outlet in a surface of the enclosure; and selectively evacuating fluid from the enclosure through the first drainage outlet in response to an accumulation of fluid at the first drainage outlet. In certain examples, the selectively evacuating may include: accumulating fluid at the first drainage outlet when the gas turbine engine is oriented in a non-horizontal orientation; and evacuating fluid through the first drainage outlet. In other examples, the accumulating may include: raising a float of a float valve in the fluid at the first drainage outlet; wherein the float is buoyant in the fluid.

In certain examples, the surface may include a second drainage outlet fluidically connected to the first drainage outlet; wherein fluid does not accumulate at the second drainage outlet when the gas turbine engine is oriented in the non-horizontal orientation.

In other examples, the method may further include blocking flow out of the enclosure through the second drainage outlet. In still other examples, the blocking may include sealing a second float valve at the second drainage outlet; wherein a second float is resting in the housing of the second float valve under gravity or suction.

The term "aft," as used herein, unless stated otherwise, alone or in combination with other terms, refers to an element, surface, or assembly being situated at, near, or toward a tail of an aircraft or other vehicle. The term "aft" may be distinguished from the term "forward," which, as used herein, unless stated otherwise, alone or in combination with other terms, refers to an element, surface, or assembly being situated at, near, or toward a front of an aircraft or other vehicle. The forward and aft directions may refer to opposite directions along an axis, which may be parallel to, or identical to, a centerline of a gas turbine engine. The terms "axial" and "axially," as used herein, unless stated otherwise, alone or in combination with other terms, refers to elements, surfaces, and assemblies along a common axis, which may be forward or aft relative to other elements, surfaces, and/or assemblies.

A gas turbine engine may be annular. The terms "radially" and "radial," as used herein, unless stated otherwise, alone or in combination with other terms, refer to elements, surfaces, or assemblies relative to one another along a radius that may project perpendicularly from a centerline axis, which may be parallel to, or identical to, a centerline of a gas turbine engine and/or a forward-aft axis. The terms "inward" and "inwardly," as used herein, unless stated otherwise, alone or in combination with other terms, refer to an element, surface, or assembly being situated at, near, or toward the centerline axis along a radius. The terms "outward" and "outwardly," as used herein, unless stated otherwise, alone or in combination with other terms, refers to an element, surface, or assembly being situated, or facing away from, the centerline axis along a radius. The terms "inward" and "inwardly" and the terms "outward" and "outwardly" may refer to opposite directions along a radius projecting perpendicularly from the centerline axis.

The terms "circumferential" and "circumferentially," as used herein, unless stated otherwise, alone or in combination with other terms, refer to elements, surfaces, or assemblies relative to one another encircling a centerline axis at a radius. Alternatively, or in addition, the terms "circumferential" and "circumferentially," as used herein, unless stated otherwise, alone or in combination with other terms, mean relating to a circumference of a circle centered on, and perpendicular to, a centerline axis.

The term "fluidically connected" refers to an attachment together of components or elements along a sealed path so as to allow a fluid to flow between the components or elements along the sealed path without inadvertent leakage of the fluid at any attachment point between components or elements.

The terms "horizontal" and "level" refer to a flight orientation in which an aircraft, or a component thereof, is substantially parallel to the surface of the earth. The terms "non-horizontal" and "un-level" refer to a flight orientation in which an aircraft, or a component thereof, is not substantially parallel to the surface of the earth.

For the purpose of this disclosure, the terms "about" and "substantially" are used herein with respect to measurable values and ranges due to expected variations known to those skilled in the art (for example, limitations and variability in measurements).

In describing elements of the present disclosure, the ordinal number terms "$1^{st}$" "$2^{nd}$," "first," "second," and the like, may be used herein. These ordinal number terms are only used to distinguish one element from another element, but do not limit the corresponding elements irrespective of the nature or order of the corresponding elements.

All methods and operations described herein may be performed in any suitable order unless otherwise indicated herein or otherwise clearly contradicted by context.

The uses of the terms "a" and "an" and "the" and similar referents in the context of describing the present disclosure (especially in the context of the following claims) are to be construed to cover both the singular and the plural, unless otherwise indicated herein or clearly contradicted by context. The use of the term "plurality of" is defined by the Applicant in the broadest sense, superseding any other implied definitions or limitations hereinbefore or hereinafter unless expressly asserted by Applicant to the contrary, to mean a quantity of more than one.

As used herein the terms "comprise(s)," "include(s)," "having," "has," "can," "contain(s)," and variants thereof, are intended to be open-ended transitional phrases, terms, or words that do not preclude the possibility of additional acts or structures. The present description also contemplates other examples "comprising," "consisting," and "consisting essentially of," the examples or elements presented herein, whether explicitly set forth or not.

While various examples have been described, it will be apparent to those of ordinary skill in the art that many more implementations are possible. Accordingly, the examples described herein are not the only possible implementations.

The subject-matter of the disclosure may also relate, among others, to the following aspects:

A first aspect relates to an oil sump system for a gas turbine engine, the oil sump system comprising: a first oil drainage outlet in a surface of the oil sump; a second oil drainage outlet in the surface, the second oil drainage outlet in liquid communication with the first oil drainage outlet; a suction pump in liquid communication with the first oil drainage outlet and the second oil drainage outlet; and a valve positioned at the first oil drainage outlet to selectively open and evacuate liquid from the oil sump through the first oil drainage outlet in response to the valve being submerged in liquid, the liquid accumulating on the surface when the gas turbine engine is at level flight.

A second aspect relates to the oil sump system of aspect 1, wherein the valve is a float valve.

A third aspect relates to the oil sump system of aspect 2, wherein a float of the float valve is buoyant in the liquid.

A fourth aspect relates to the oil sump system of any preceding aspect, wherein the liquid is a lubricant.

A fifth aspect relates to the oil sump system of any preceding aspect, further comprising a second valve positioned at the second oil drainage outlet to selectively open and evacuate fluid from the oil sump through the second oil drainage outlet in response to the second valve being submerged in liquid.

A sixth aspect relates to the oil sump system of any preceding aspect, comprising a third oil drainage outlet in the surface, the third oil drainage outlet in liquid communication with the first oil drainage outlet and the second oil drainage outlet.

A seventh aspect relates to the oil sump system of aspect 6, wherein the third oil drainage outlet is positioned at a location in the surface of the oil sump that is farther from the suction pump along a scavenge conduit in fluid communication with the suction pump and the third oil drainage outlet than the first oil drainage outlet and the second oil drainage outlet, the first oil drainage outlet and the second oil drainage outlet in fluid communication with the suction pump by the scavenge conduit.

An eighth aspect relates to the oil sump system of any preceding aspect, wherein the first oil drainage outlet is positioned at a location in the surface of the oil sump that is closer to the suction pump along a scavenge conduit in fluid communication with the suction pump and the first oil drainage conduit, the first oil drainage outlet and the second oil drainage outlet in fluid communication with the suction pump by the scavenge conduit.

A ninth aspect relates to a scavenge system for a gas turbine engine, the scavenge system comprising: a first drainage outlet in a surface of an enclosure of a cavity in the gas turbine engine; a second drainage outlet in the surface, the second drainage outlet in liquid communication with the first drainage outlet; a suction pump in liquid communication with the first drainage outlet and the second drainage outlet; and a valve positioned at the first drainage outlet to selectively open and evacuate liquid from the cavity through the first drainage outlet in response to the valve being submerged in liquid, the liquid accumulating on the surface when the gas turbine engine is at level flight.

A tenth aspect relates to the scavenge system of aspect 9, wherein the valve is a float valve.

An eleventh aspect relates to the scavenge system of aspect 9 or 10, wherein the liquid is a lubricant.

A twelfth aspect relates to the scavenge system of any one of aspects 9 to 11, further comprising a second valve positioned at the second drainage outlet to selectively open and evacuate liquid from the cavity through the second drainage outlet in response to the second valve being submerged in liquid.

A thirteenth aspect relates to the scavenge system of any one of aspects 9 to 12, comprising a third drainage outlet in the surface, the third drainage outlet in liquid communication with the first drainage outlet and the second drainage outlet.

A fourteenth aspect relates to the scavenge system of any one of aspects 9 to 13, wherein the first oil drainage outlet is positioned at a location in the surface of the enclosure that is closer to the suction pump along a scavenge conduit in fluid communication with the suction pump and the first oil drainage conduit, the first oil drainage outlet and the second oil drainage outlet in fluid communication with the suction pump by the scavenge conduit.

A fifteenth aspect relates to a method of reducing suction of air from an enclosure of a cavity of a gas turbine engine, the method comprising: blocking flow of air out of the enclosure through a first drainage outlet in a surface of the enclosure; and selectively evacuating liquid from the enclosure through the first drainage outlet in response to an accumulation of the liquid at the first drainage outlet, the liquid accumulating on the surface when the gas turbine engine is operating at level flight.

A sixteenth aspect relates to the method of aspect 15, wherein the selectively evacuating comprises: accumulating the liquid at the first drainage outlet when the gas turbine engine is oriented in a non-horizontal orientation; and evacuating the liquid through the first drainage outlet.

A seventeenth aspect relates to the method of aspect 16, wherein the accumulating comprises: raising a float of a float valve in the liquid at the first drainage outlet; wherein the float is buoyant in the liquid.

An eighteenth aspect relates to the method of aspect 16 or 17, wherein the surface comprises a second drainage outlet, the second drainage outlet in liquid communication with the first drainage outlet; and wherein the liquid does not accumulate at the second drainage outlet when the gas turbine engine is oriented in the non-horizontal orientation.

A nineteenth aspect relates to the method of aspect 18, wherein the method further comprises: blocking flow of air out of the enclosure through the second drainage outlet.

A twentieth aspect relates to the method of aspect 19, wherein the blocking comprises: sealing a second float valve at the second drainage outlet; wherein a second float is resting in a seat of the second float valve under gravity or suction.

In addition to the features mentioned in each of the independent aspects enumerated above, some examples may show, alone or in combination, the optional features mentioned in the dependent aspects and/or as disclosed in the description above and shown in the figures.

What is claimed is:

1. An oil sump system for a gas turbine engine, the oil sump system comprising:

a first oil drainage outlet in a surface of an enclosure of the oil sump system;

a second oil drainage outlet in the surface, the second oil drainage outlet in liquid communication with the first oil drainage outlet, wherein the surface is substantially unobstructed between at least the first oil drainage outlet and the second oil drainage outlet such that liquid is free to flow between the first oil drainage outlet and the second oil drainage outlet along the surface due to, at least in part, an orientation of the gas turbine engine; wherein an entry of the first oil drainage outlet, an entry of the second oil drainage outlet, and the surface extending therebetween are substantially coplanar;

a suction pump in liquid communication with the first oil drainage outlet and the second oil drainage outlet; and a valve positioned at the first oil drainage outlet to selectively open and evacuate the liquid from the enclosure of the oil sump system through the first oil drainage outlet in response to the valve being submerged in the liquid, the liquid accumulating on the surface when the gas turbine engine is at level flight.

2. The oil sump system of claim 1, wherein the valve is a float valve.

3. The oil sump system of claim 2, wherein a float of the float valve is buoyant in the liquid.

4. The oil sump system of claim 1, wherein the liquid is a lubricant.

5. The oil sump system of claim 1, further comprising a second valve positioned at the second oil drainage outlet to selectively open and evacuate fluid from the enclosure of the oil sump system through the second oil drainage outlet in response to the second valve being submerged in the liquid.

6. The oil sump system of claim 1, comprising a third oil drainage outlet in the surface, the third oil drainage outlet in liquid communication with the first oil drainage outlet and the second oil drainage outlet, the third oil drainage outlet being unobstructed such that the third oil drainage outlet is open during all operating conditions of the gas turbine engine and the liquid is free to drain out of the third oil drainage outlet during all operating conditions of the gas turbine engine.

7. The oil sump system of claim 6, wherein the third oil drainage outlet is positioned at a location in the surface of the enclosure of the oil sump system that is farther from the suction pump along a scavenge conduit in fluid communication with the suction pump and the third oil drainage outlet than the first oil drainage outlet and the second oil drainage outlet, the first oil drainage outlet and the second oil drainage outlet in fluid communication with the suction pump by the scavenge conduit.

8. The oil sump system of claim 1, wherein the first oil drainage outlet is positioned at a location in the surface of the enclosure of the oil sump system that is closer to the suction pump along a scavenge conduit in fluid communication with the suction pump and the first oil drainage outlet than the second oil drainage outlet, the first oil drainage outlet and the second oil drainage outlet in fluid communication with the suction pump by the scavenge conduit.

9. The oil sump system of claim 1, wherein the surface of the enclosure is a bottom surface of the enclosure, and wherein the first oil drainage outlet and the second oil drainage outlet are axially spaced apart from one another along the bottom surface.

10. The oil sump system of claim 1, wherein the enclosure includes an aft wall, a forward wall axially spaced apart from the aft wall, and a bottom wall extending between and interconnecting bottom ends of the aft wall and the forward wall, and wherein the bottom wall defines the surface through which the first oil drainage outlet and the second oil drainage outlet are formed.

11. A scavenge system for a gas turbine engine, the scavenge system comprising:

a first drainage outlet in a surface of an enclosure of a cavity in the gas turbine engine;

a second drainage outlet in the surface, the second drainage outlet in liquid communication with the first drainage outlet, wherein an entry of the first drainage outlet, an entry of the second drainage outlet, and the surface extending therebetween are substantially coplanar;

a suction pump in liquid communication with the first drainage outlet and the second drainage outlet; and a valve positioned at the first drainage outlet to selectively open and evacuate liquid from the cavity through the first drainage outlet in response to the valve being submerged in the liquid, the liquid accumulating on the surface when the gas turbine engine is at level flight, and wherein the second drainage outlet is unobstructed such that the second drainage outlet is open during all operating conditions of the gas turbine engine and the liquid is free to drain out of the second drainage outlet during all operating conditions of the gas turbine engine.

12. The scavenge system of claim 11, wherein the valve is a float valve.

13. The scavenge system of claim 11, wherein the liquid is a lubricant.

14. The scavenge system of claim 11, further comprising a third drainage outlet in the surface, the third drainage outlet in liquid communication with the first drainage outlet and the second drainage outlet.

15. The scavenge system of claim 14, further comprising a second valve positioned at the third drainage outlet to selectively open and evacuate the liquid from the cavity through the third drainage outlet in response to the second valve being submerged in the liquid, and wherein the first drainage outlet and the third drainage outlet are positioned closer to the suction pump along a scavenge conduit than the second drainage outlet, the first drainage outlet, the second drainage outlet, and the third drainage outlet being in fluid communication with the suction pump by the scavenge conduit.

16. The scavenge system of claim 15, wherein the surface is substantially unobstructed between at least the first drainage outlet, the second drainage outlet, and the third drainage outlet such that liquid is free to flow between the first drainage outlet, the second drainage outlet, and the third drainage outlet along the surface due to, at least in part, an orientation of the gas turbine engine.

17. The scavenge system of claim 11, wherein the first drainage outlet is positioned at a location in the surface of the enclosure that is closer to the suction pump along a scavenge conduit in fluid communication with the suction pump and the first drainage outlet than the second drainage outlet, the first drainage outlet and the second drainage outlet in fluid communication with the suction pump by the scavenge conduit.

18. The scavenge system of claim 11, wherein the surface is substantially unobstructed between at least the first drainage outlet and the second drainage outlet such that liquid is free to flow between the first drainage outlet and the second drainage outlet along the surface due to, at least in part, an orientation of the gas turbine engine.

19. The scavenge system of claim 11, wherein the surface of the enclosure is a bottom surface of the enclosure, and wherein the first drainage outlet and the second drainage outlet are axially spaced apart from one another along the bottom surface.

20. The scavenge system of claim 11, wherein the enclosure includes an aft wall, a forward wall axially spaced apart from the aft wall, and a bottom wall extending between and interconnecting bottom ends of the aft wall and the forward wall, and wherein the bottom wall defines the surface through which the first drainage outlet and the second drainage outlet are formed.

* * * * *